United States Patent [19]

Dubost et al.

[11] Patent Number: 4,922,263

[45] Date of Patent: May 1, 1990

[54] PLATE ANTENNA WITH DOUBLE CROSSED POLARIZATIONS

[75] Inventors: Gérard Dubost, Rennes; Roger Frin, Liffre, both of France

[73] Assignee: L'Etat Francais, represente par le Ministre des PTT, Centre National d'Etudes des Telecommunications (CNET), Paris Cedex, France

[21] Appl. No.: 344,412

[22] Filed: Apr. 25, 1989

Related U.S. Application Data

[63] Continuation of Ser. No. 41,705, Apr. 22, 1987, abandoned.

[30] Foreign Application Priority Data

Apr. 23, 1986 [FR] France ..... 86 05990

[51] Int. Cl.[5] ..... H01Q 21/26; H01Q 1/38

[52] U.S. Cl. ..... 343/797; 343/700 MS; 343/833

[58] Field of Search ..... 343/700 MS File, 727, 343/794, 795, 797, 803, 815, 817, 818, 819, 833, 767

[56] References Cited

U.S. PATENT DOCUMENTS

| | | | |
|---|---|---|---|
| 3,541,559 | 7/1970 | Evans | 343/756 |
| 3,680,142 | 7/1972 | Van Atta et al. | 343/797 |
| 3,945,016 | 3/1976 | Bizooand et al. | 343/833 |
| 4,114,163 | 9/1978 | Borowick | 343/815 |
| 4,426,649 | 1/1984 | Dubost et al. | 343/803 |
| 4,486,758 | 12/1984 | de Ronde | 343/700 MS |
| 4,590,478 | 5/1986 | Dowers et al. | 343/700 MS |

FOREIGN PATENT DOCUMENTS

| | | | |
|---|---|---|---|
| 2138384 | 10/1982 | Fed. Rep. of Germany | 343/833 |
| 2565417 | 3/1985 | France . | |

OTHER PUBLICATIONS

"Comptes Renous. Serie C. Sciences Chimiques" vol. 295, No. 2, Sep. 1982, pp. 124–127, 129, 130 Dubost.

IEEE Transactions on Antennas & Propagation, vol. 23, No. 5-Sep. 1975-pp. 687-689.

*Primary Examiner*—Rolf Hille
*Assistant Examiner*—Doris J. Johnson
*Attorney, Agent, or Firm*—Daniel Rubin

[57] ABSTRACT

The radiating portion of the antenna is formed from two similar radiating doublets (1,3; 2,4) which are located in a single plane and are orthogonal, with the slots between driven elements of the doublets crossing one another at the center (C) of the unit antenna.

The two doublet modules (1,3; 2,4) are associated with the central conductors of three-plate lines which are orthogonal, with their extensions crossing one another beneath the center (C) of the antenna. Each three-plate line consists of the plates (1,3; 2,4) of a doublet, on the one hand, a reflector, on the other hand, and between the plates and the reflector, the central conductor. The reflector is common to the two doublets.

13 Claims, 5 Drawing Sheets

PLATE ANTENNA WITH DOUBLE CROSSED POLARIZATIONS

Figure 2:
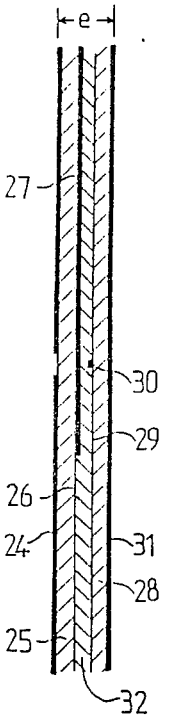

This application is a continuation of application Ser. No. 07/041,705, filed Apr. 22, 1988.

This invention pertains to a plate antenna with double crossed polarizations, said antennas being especially designed to form arrays operating in the frequency and ranging from a few hundred MHz to a few tens GHz.

Arrays of plate antenna modules consisting of thick driven element folded doublets realized as printed circuits are particularly suitble for sending or receiving radio signals in the 12 GHz band. Such an array is described in French Patent A-2,487,588. A rotationally symmetrical antenna array designed more specifically for sending terrestrial radio broadcast signals in the 12 GHz band is also described in French Patent Application No. 85 08840, filed on June 10, 1985 jointly in the names of the present applicatants and entitled "Cylindrical omnidirectional antenna". This antenna has an omnidirectional radiation pattern in azimuth and a much more narrow pattern in elevation.

One object of the invention involves providing for a plate antenna module based on the operation of driven thick element folded doublets and realized with printed circuits, which is capable of receiving, but possibly also of emitting, electromagnetic waves with any polarization, i.e., left elliptical or right elliptical, in the 12 GHz band. More particularly, the elliptical polarization can, at the limit, be circular or reduced to rectilinear. Such an antenna, called a double crossed polarization antenna, is designed to be used in an array capable of receiving radio signals broadcast by a satellite with a right or left circular polarization.

According to one characteristic of the invention, provision is made for an antenna module whose radiating portion is formed by two similar radiating thick element folded doublets located in a single plane and orthogonal, with the slots between the driven elements of the doublets crossing one another at the center of the antenna module.

According to another characteristic, the doublets of the antenna module are respectively associated with central conductors of three-late lines which are othogonal, with their extensions crossing one another beneath the center of the antenna, with each three-plate line consisting of the plate of a doublet, on the one hand, a reflector, on the other hand, and between the plates and the reflector, the central conductor, with the reflector being common to the two doublets.

According to another characteristic, the doublets consist of four plates separated by a nonconductive cross whose center coincides with the center of the antenna module, with each end of an arm of the cross ending at a first nonconductive area bordered externally by a conductive strip connected to the rear parts of the two plates adjacent to the said arm, with a second finite nonconductive area being provided beyond the conductive strip, with the first areas, the strips and the second areas being symmetrical with respect to the center of the antenna module and the axes of symmetry of the doublets.

According to another characteristic, the antenna module is realized in the form of a first printed circuit with a first metallized surface from which the cross, the first areas and the second areas have been cut out, and a second metallized surface on which all that remains in the first central conductor, and a second printed circuit with a first surface on which all that remains is the second central conductor and a second entirely metallized surface serving as a reflector, with the two printed circuits, once suitably oriented, being superposed with an insulating layer between them.

According to another characteristic, director elements are placed in front of the plates of the doublets, separated from them by an insulating layer.

According to another characteristic, an array of antenna modules as defined above is provided, with the first central conductors all being associated with the first doublets and the second central conductors being associated with the second doublets.

Figure 1:
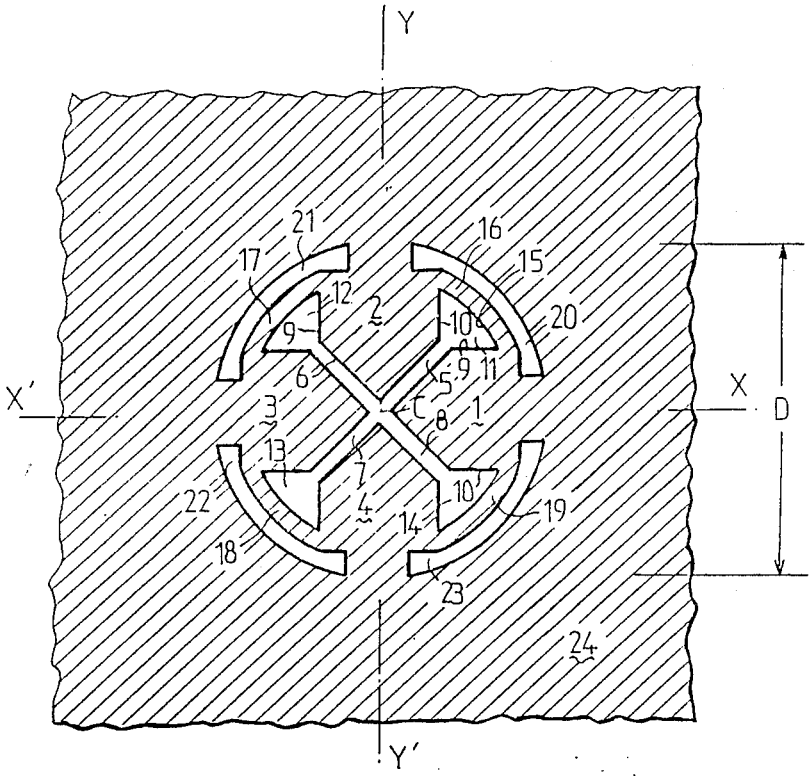
Figure 5:
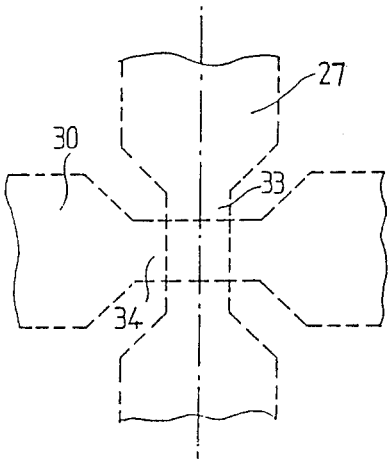
Figure 8:
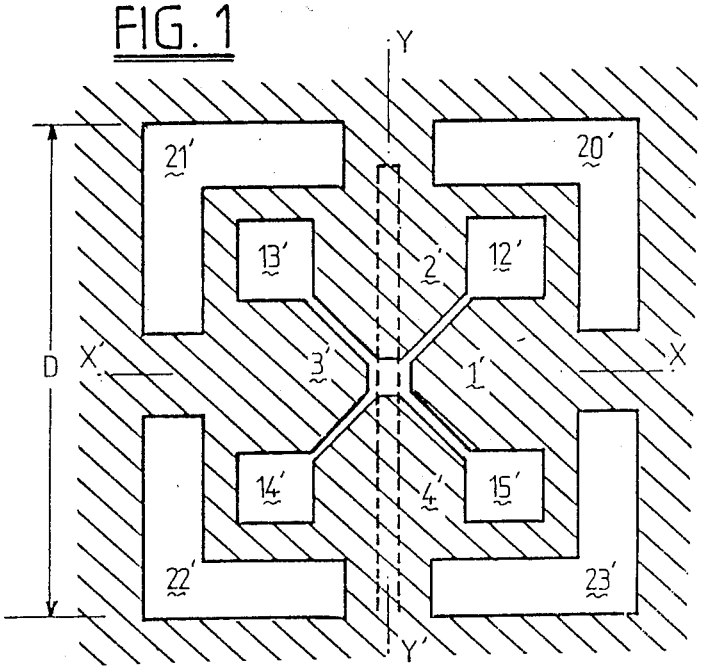
Figure 3:
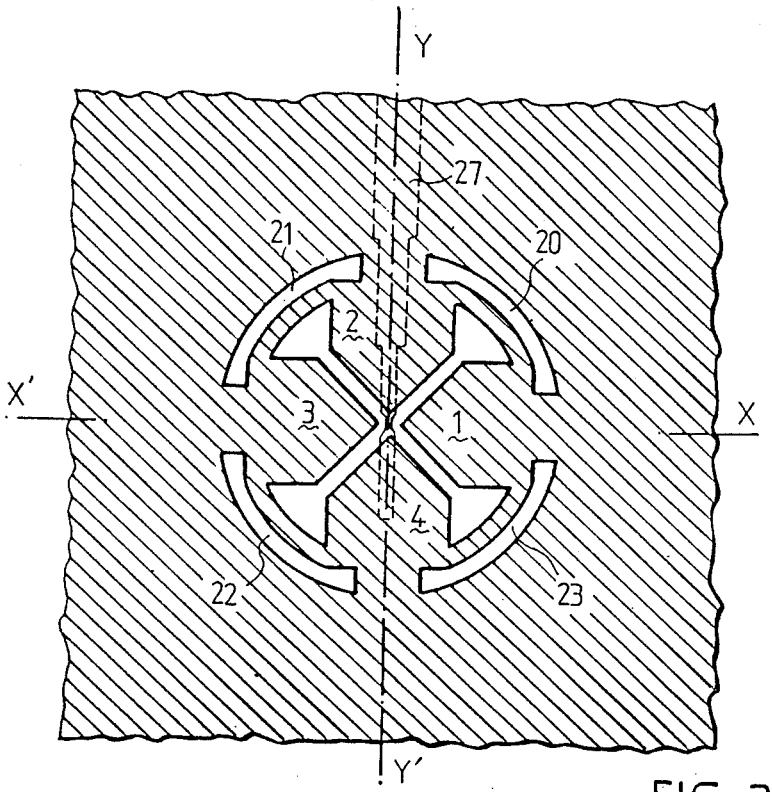
Figure 4:
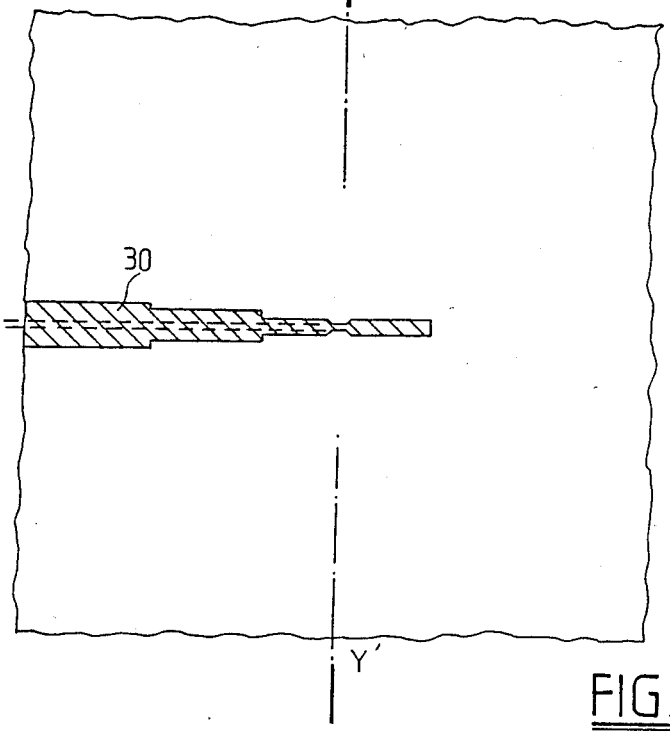
Figure 6:
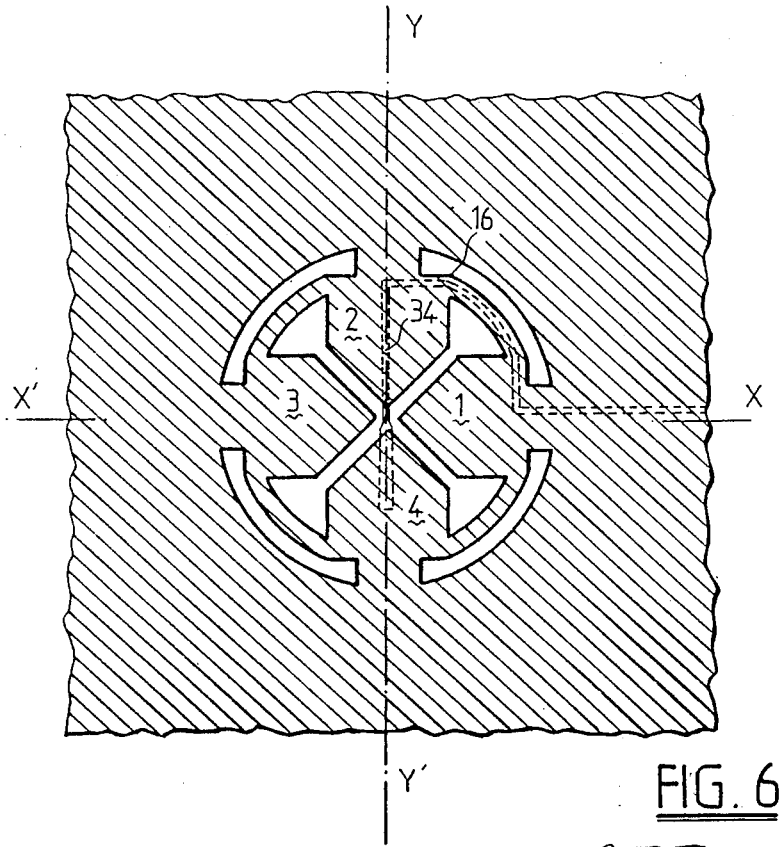
Figure 7:
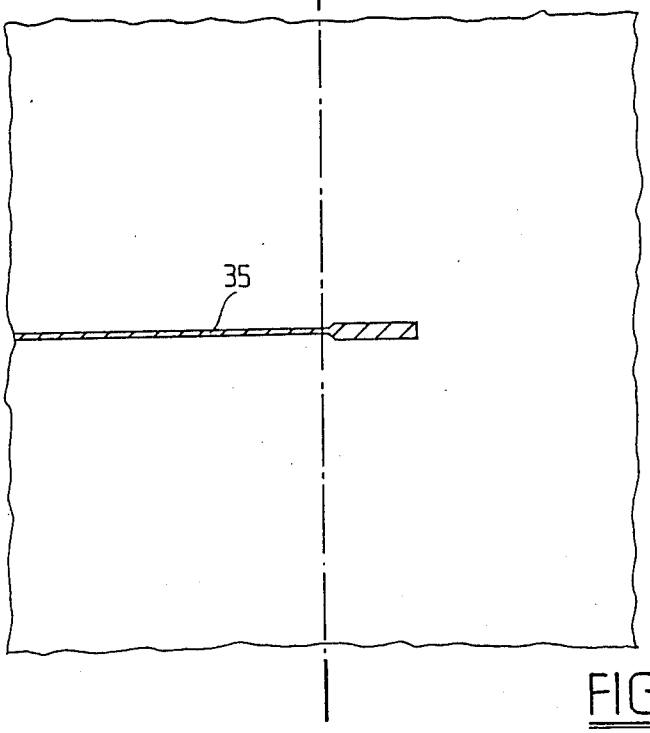
Figure 9:
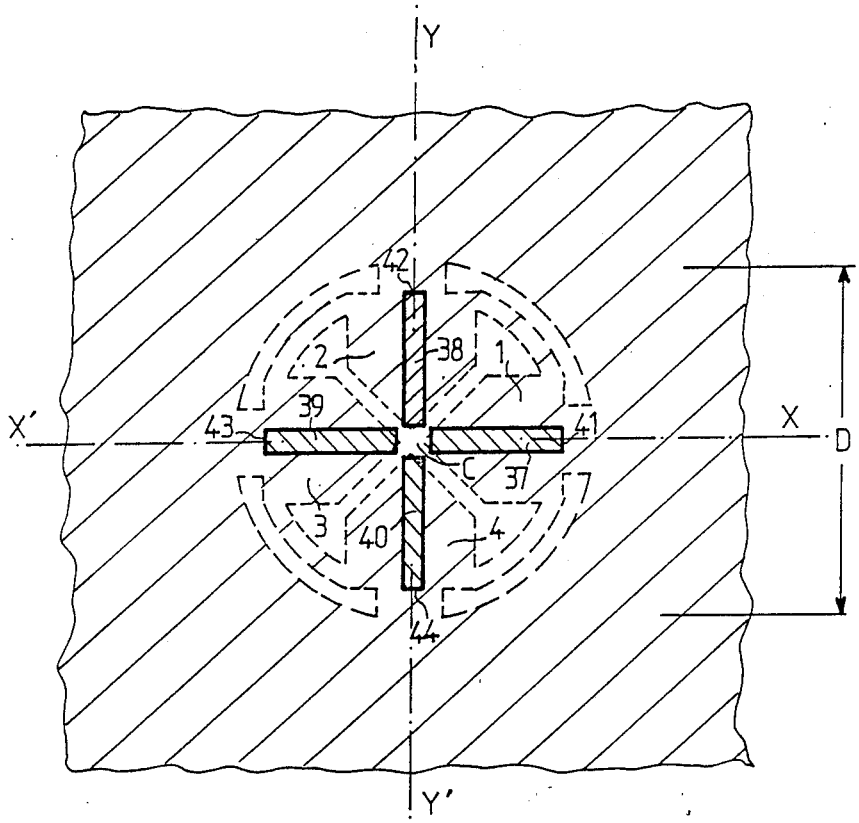
Figure 10:
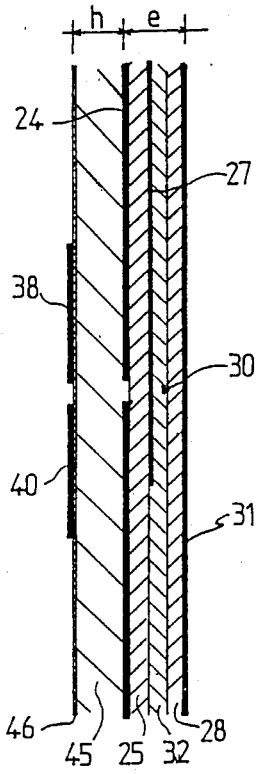
Figure 11:
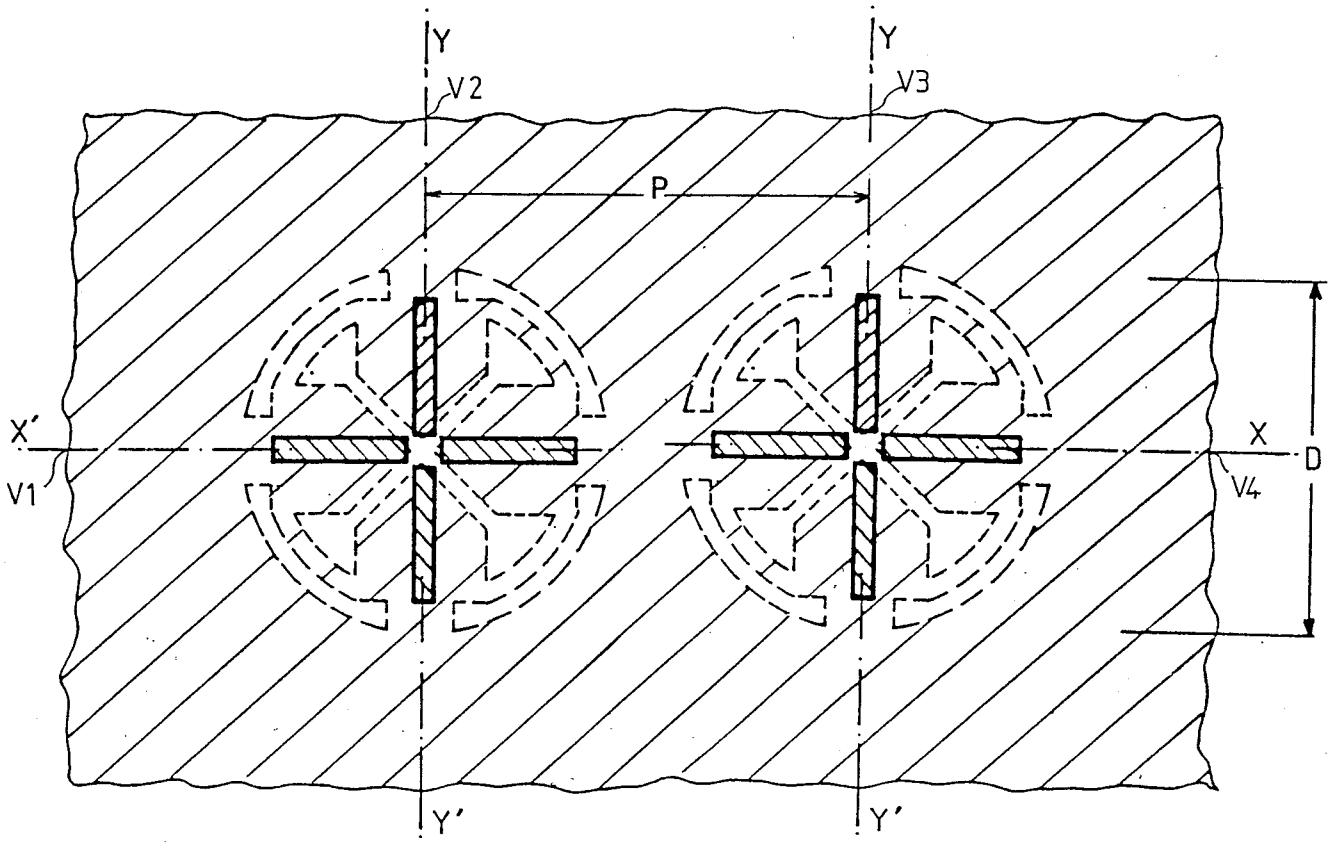

The characteristics of the invention mentioned above, as well as others, will appear more clearly upon reading the following description of examples of embodiments, said description being given with reference to the attached drawings, in which:

FIG. 1 is a top view of the radiation portion of the antenna according to the invention, FIG. 2 is a sectional view of the antenna according to the invention along line Y-Y' in FIG. 1, FIG. 3 is a top view of a first printed circuit which bears the radiating portion of the antenna and a signal feeder line, FIG. 4 is a top view of a second printed circuit which bears the reflector for the antenna and for its original signal feeder line, FIG. 5 is a schematic view illustrating how the signal feeder lines for the doublets constituting the antenna in FIGS. 1 through 4 cross one another in superposed fashion, FIG. 6 is a view showing a variant of the printed circuit in FIG. 3, FIG. 7 is a view showing a variant of the printed circuit in FIG. 4, FIG. 8 is a schematic view of a variant of the radiating structure according to the invention, FIG. 9 is a view of another variant of the antenna according to the invention in which the director elements are placed in front of the radiating structure in FIG. 1, FIG. 10 is a sectional view of the antenna in FIG. 9 along line Y-Y' thereon, FIG. 11 shows an assemblage of two antennas which was used for experimental purposes.

In a first example of an antenna according to the invention, the radiating portion, shown in FIG. 1, comprises two orthogonal pairs of wide conductive plates, namely, the pair of plates 1 and 3 with an axis of symmetry X-X', on the one hand, and the pair of plates 2 and 4 with an axis of symmetry Y-Y', on the other hand. The assemblage of conductive plates 1 through 4 occupies the quadrants defined by a nonconductive cross, the orientations of whose arms 5 through 8 are shifted 45° with respect to the axes of symmetry X-X' and Y-Y' of the plates 1 through 4. In practice, each plate 1 through 4 has an angular end whose edges are formed by two adjacent arms of the cross. Beyond the external ends of the arms 5 through 8, the plates have their two lateral edges 9 and 10, respectively, parallel to the axis of symmetry X-X' or Y-Y' of the plate in question.

Also provided beyond the outer ends of the four arms 5 through 8 of the cross are four limited nonconductive areas 11 through 14, respectively. In FIG. 1, the areas 11 through 14 are defined towards the center by the end of the corresponding arm by the adjacent lateral edges 9 and 10 of two adjacent conductive plates and, toward the outside, by an arc of a circle 15, centered in the center of the cross. Beyond the arc of a circle 15 of each nonconductive area 11 through 14 are provided conductive ring segments 16 through 19, respectively, which are also centered in the center of the cross. The ring segment 16 connects plates 1 and 2, the segment 17 connects plates 2 and 3, etc.

Provided beyond the conductive ring segments 16 through 19 are four nonconductive ring segments 20 through 23, respectively. The rings 16 and 20 are symmetrical with respect to the axis of arm 5, the segments 17 and 21 are symmetrical with respect to the axis of arm 6, etc. The nonconductive ring segments 20 through 23 are longer than the conductive ring segments 16 through 19, and their ends are respectively closer to the axes X-X' and Y-Y' than the edges 9 and 10 of each conductive plate 1 through 4.

The widths of the cross arms 5 through 8 and the nonconductive segments 20 through 23 are of the same order of magnitude and, more generally, very small with respect to the wavelength.

In practice, the conductive portions of the radiating portion shown in FIG. 1 are formed from one surface 24, initially completely metallized, of a double-sided printed circuit 25, FIG. 2, the other surface 26 of which bears the central metallic conductor 27 of a first three-plate signal feeder line. Another double-sided printed circuit 28 bears, on one surface 29, the central metallic conductor 30 of a second three-plate signal feeder line, and on its other surface, the metallized reflector 31.

The nonconductive portions 5 through 8, 11 through 14 and 20 through 23 are obtained by removing the corresponding portions of the surface 24.

The two printed circuits 25 and 28 are superposed with their surfaces 26 and 29 facing one another, and they are separated by a thin layer 32 of dielectric substrate.

As FIGS. 1 and 2 show, the central conductor 27 is aligned along axis Y-Y' and passes, beginning from the signal source (not shown) beneath the plate 2, beneath the nonconductive center C of the cross, then beneath the plate 4, ending approximately a quarter of a wavelength from the center C. Beneath the surface 24, beyond the nonconductive portions 20 and 21, the conductor 27 has a width allowing it to be adjusted to a nominal impedance, for example, 50 or 100 ohms; as it passes beneath the interval between 20 and 21, its width is reduced to approximately half this interval; in the middle of the plate 2, its width is reduced to approximately half the interval between the ends of two facing plates 1 and 3 or 2 and 4; around the center, its width is even further reduced, as will be seen with reference to FIG. 5; finally, in its final portion, beneath the plate 4, its width again becomes equal to that which it had before the center C.

As FIG. 4 shows, the central conductor 30, aligned along the axis X'-X, has a width which changes like that of the conductor 27 as it passes successively beneath the plates 3 and 1.

Each conductor 27 or 30 forms, with the completely metallized surface 31, on the one hand, and the conductive parts of the surface 24, on the other hand, a three-plate line.

The pair of plates 1 and 3 constitutes, with the central conductor 30 and the reflector 31, a first linearly polarized radiating doublet. This doublet is symmetrical, and its adjacent ends are excited in opposite phase. In addition, this is a folded doublet whose thick elements consist of the plates 1 and 3 while the folded, nonexcited elements consist, on the one hand, of the ring segments 15 and 17 plus the outer part of the plate 3, and on the other hand, of the ring segments 19 and 18 plus the outer part of the plate 4.

The pair of plates 2 and 4 constitutes, together with the central conductor 27 and the reflector 31, a second linearly polarized radiating doublet. This doublet is also symmetrical, and its adjacent ends are excited in opposite phase. It is easy to confirm that this is also an excited thick element doublet.

It will be evident that the currents of the two doublets cross in each outer portion of a plate 1 through 4. However, because of the fact that, for the first doublet, the line Y-Y' is at zero potential while for the second doublet, the line X-X' is also at zero potential, the decoupling between the doublets is large.

It will also be evident from FIG. 2 that the feed conductor 30 for the first doublet is slightly further away from the plates 1, 3 than the conductor 27 for the plates 2, 4 for the second doublet, but in turn closer to the reflector 31. This distance, equal to half the width of the layer 32 with respect to a center position in the middle of the layer 32 has practically no effect on the operation of the doublet, to the extent that the thickness of the insulating layer 32 is small.

As FIG. 5 shows and as has already been mentioned, the widths of the conductors 27 and 30 are reduced around the center of the antenna at 33 and 34. This reduction makes it possible to decrease the coupling between the two doublets.

The electrical moments of the two radiating doublets are therefore located in the same plane and are orthogonal to one another. To emit or receive a wave of any polarization, all that is necessary is to correctly dephase the two signals emitted or received at each of the central conductors 27 and 30. In the present specification, it would not be useful to use details of a dephaser capable of performing this operation, since such dephasers are known to the person skilled in the art.

For purposes of experimentation, a radiating source having the structure defined in FIGS. 1 to 5 was realized and tested. This source operated in the frequency band between 3.65 and 4.05 GHz. The overall diameter of the source, that is, the diameter D of the outside edges of the ring segments 20 through 23, was equal to 51 mm, which leads to a ratio $$D/(\lambda_o)_m = 0.65$$

where $(\lambda_o)_m$ designates the wavelength in free space at the average frequency of 3.85 GHz.

The printed circuits 25 and 28 were 3.2 mm thick, with a relative dielectric constant $\epsilon_r = 2.55$. The insulating layer 32 was Teflon 0.3 mm thick with a relative dielectric constant $\epsilon_r = 2.1$.

The overall diameter e (FIG. 2) was therefore 6.7 mm with a ratio:

$$e/(\lambda_o)_m = 0.086$$

The radiation resistance of a doublet at the average frequency of 3.85 GHz, measured between the adjacent ends of a doublet, is in the vicinity of 100 ohms. By means of the sections of different lengths of the central conductors, mentioned above, each doublet was adjusted to 50 ohms.

Table I below summarizes the experimental results obtained in the passband on a single doublet, with the other doublet being short-circuited on an adjusted load of 50 ohms.

TABLE I

| f(GHz) | 3.6 | 3.7 | 3.8 | 3.9 | 4 | 4.1 |
|---|---|---|---|---|---|---|
| $O_E$ (degrees) | 94 | 71 | 70 | 74 | 82 | 92 |
| $O_H$ (degrees) | 73 | 59 | 53 | 49 | 70 | 66 |
| Max. gain (dB) | 7.4 | 8.1 | 8.7 | 7.3 | 7.4 | 5.9 |
| SWR/50 ohms | 1.33 | 1.22 | 1.32 | 1.22 | 1.78 | |
| c.c (dB) | * | −23 | −18 | −16 | −16 | −16 |
| Dec (dB) | −20.0 | −25.2 | −22.0 | −21.6 | −22.5 | −20 |

where $O_E$ and $O_H$ represent the openings at 3 dB in the planes "E" and "H", respectively; SWR designates the standing wave ratio; c.c designates the cross component along the maximum radiating axis, Dec designates the decoupling between the two doublets; and * indicates that the measurement was not made.

Table II shows the polarization rate $\tau$ measured along the maximum radiating axis while the source was operating in circular polarization. For this, the two central conductors 27 and 30 are connected to a 3 dB directional coupler which creates a 90° dephasing between the signals emitted and received at the two doublets.

TABLE II

| f(GHz) | 3.6 | 3.7 | 3.8 | 3.9 | 4 | 4.1 |
|---|---|---|---|---|---|---|
| $\tau$(dB) | 0.8 | 2 | 2.1 | 2.4 | 1 | 1.1 |

The relatively high polarization rate results from a small difference between the radiation impedances of the two doublets due to the asymmetry of the two three-plate lines with respect to the radiating structure. An impedance adjustment, slightly different from each doublet, makes it possible to obtain currents of equal amplitude and phase quadrature and a polarization rate of less than one dB.

In the example of an embodiment in FIG. 6, the central conductor 34 of the three-plate line which feeds the second doublet formed by plates 2 and 4 has its terminal part placed, along axis Y-Y', in a manner similar to that of conductor 27, but beneath the outer portion of plate 2, it changes direction by 90°, passing beneath the ring segment 16, practically in an arc of a circle up to the axis X'-X, and again changing direction to move away from the source along that axis.

The variant in FIG. 6 can allow a different arrangement of the sources to form an array.

In addition, as FIGS. 6 and 7 show, the central conductors 35 and 36, the latter serving to excite the first doublet formed by plates 1 and 3, are each formed by a narrow strip which widens after passing beneath the interval between the plates. This structure for the central conductors is a variant of the one in FIGS. 3 and 4 and allows the antenna to operate at a nominal impedance of 100 ohms.

FIG. 8 schematically shows a variant of the radiating structure composed of two pairs of doublets 1', 3' and 2', 4', which are entirely analogous to the two pairs 1, 3 and 2, 4. The plates of these doublets are defined by a nonconductive cross, as in FIG. 1. The principal structural differences have to do with the square shapes of the nonconductive areas 12' through 15' and the L-shapes of the areas 20' through 23', while the corresponding areas on FIG. 1 had a circular geometry. The characteristics of the source in FIG. 8 are similar to those of the one in FIG. 1, although its overall dimensions are appreciably greater because of a relative dielectric constant $\epsilon_r$ for the printed circuits 25 and 28 which is close in unity. In particular, its $C/(\lambda_o)_m$ ratio, where C represents the side of the square formed by the outer edges of the areas 20' through 23', is greater than one, which means that it cannot be used in a dense array.

It must be remembered that, in the two structures with circular geometry and square geometry, the following are encountered beginning at the center of the source:

along axis X-X' or Y-Y', a conductive plate, and along the bisectors of the quadrants defined by these axes, a nonconductive cross arm, followed by a first nonconductive area, followed by a conductive strip, followed by a second nonconductive strip and finally a second conductive area.

In one case, the strips are ring segments; in the other, they are segments of L-shapes. Of course, any shape intermediate between these two shapes might be suitable in functional terms. However, the circular geometry is preferable, since it allows for a $D/(\lambda_o)_m$ ratio of 0.65, i.e., a dense array configuration, in which the pitch of the array is less than one wavelength.

The radiating source according to the invention makes it possible to create an array of identical sources in which the first doublets are associated with central three-plate line conductors oriented along a single direction, while the second doublets are associated with central conductors oriented perpendicularly.

The antenna in FIG. 9 comprises the same radiating structure as the one in FIG. 1, as well as the same three-plate feed lines (not shown) and the same numerical references have been repeated to designate the same parts thereon, especially the plates 1 through 4 and the nonconductive ring segments 20 through 23. The antenna in FIG. 9 also comprises four metallic director elements 37 through 40. The director elements 37 through 40 are the four arms of a cross, made of a highly conducting material, for example, a metal such as copper, whose origins are at a slight distance from the center of the cross, which coincides, in plan, with the center C of the radiating structure formed by the plates 1 through 4. The director elements 37 and 39 are aligned with the axis X-X' and are placed above the plates 1 and 3, respectively. The director elements 38 and 40 are aligned with the axis Y-Y' and are placed above the plates 2 and 4, respectively. The common width of the director elements 37 through 40 is constant and considerably less than that of the plates 1 through 4. Their ends 41 through 44, furthest from the center, are within the external limits of the radiating structure. The longitudinal sides of the director elements are, in plan, symmetrical with respect to the axes X-X' and Y-Y', respectively. All of the director elements have the center C as their center of symmetry.

As the cross section in FIG. 10 shows, the director elements 37 through 40 are plated onto an insulating layer 45 which defines the interval h between the plate of the radiating structure and that of the director elements.

In one example of an embodiment, each director element 37 through 40 was a metal strip 5 mm wide and 19.5 mm long. The respective distances between the director elements 37 and 39, and 38 and 40 are 2.5 mm above the center C. As an example, the metal strips of the director elements 37 through 40 can be printed on a printed circuit 46 in glass/Teflon 0.2 mm thick with a relative dielectric constant $\epsilon_r$ equal to 2.5. The printed circuit 46 is separated from the radiating structure 1 through 4 by a layer of insulator 45 whose thickness h was 5 mm. The layer of insulator 45 was made of "Klégécel", whose dielectric constant is close to 1.

As FIG. 11 shows, two such assemblages of director elements were tested with two radiating structures whose diameter was 52 mm or close to the diameter D of the structure in FIG. 1. Several distances P between the centers of the two antennas were selected, particularly to study the effect of this distance P on the coupling between the antennas. More particularly, in the antenna in FIGS. 9 and 10, each of the printed circuits 25 and 28 made of glass/Teflon ($\epsilon_r$=2.55) has a thickness of 3.05 mm, including the copper layers, and the insulating layer 32, without copper, is also made of glass/Teflon 0.2 mm thick (instead of 0.3 mm of Teflon with $\epsilon_r$=2.1 for the antenna in FIGS. 1 and 2).

In FIG. 11, the feed lines for the assemblage at the left as one faces the drawing end at the points V1 and V2, and those for the assemblage on the right end at the points V3 and V4.

Table III below shows, for several frequencies, the standing wave ratios for the input impedance, measured at each of the terminals V1 through V4. For each measurement at a feed point, the others are short-circuited to the standardized resistance of 50 ohms. For this set of measurements, the distance P between the antennas was 55 mm, which corresponds to the average frequency $\lambda_m$ at the ratio $P/\lambda_m$=0.68. The first part of Table III gives the results of measurements made in the presence of director elements, while the second part gives the results of measurements made without the director elements, with bare radiating structures.

The improvement resulting from the director elements may clearly be seen from Table III. Thanks to the director elements, one can, for example, create an adaptation corresponding to a standing wave ratio (SWR) of less than 1.5 in a passband of 8.5%. Note that the scatter in the SWR values among the various terminals V1 through V4 is only due to the relatively mediocre precision with which the experimental antennas were constructed.

TABLE III

| f(GHz) | | 3.50 | 3.55 | 3.60 | 3.65 | 3.70 | 3.75 | 3.80 | 3.85 | 3.90 | 3.95 |
|---|---|---|---|---|---|---|---|---|---|---|---|
| SWR | V1 | 1.55 | 1.18 | 1.03 | 1.18 | 1.21 | 1.30 | 1.55 | 1.90 | 2.80 | |
| with | V2 | 1.63 | 1.10 | 1.08 | 1.18 | 1.07 | 1.14 | 1.18 | 1.53 | 2.10 | |
| direc- | V3 | 1.70 | 1.15 | 1.12 | 1.30 | 1.08 | 1.13 | 1.25 | 1.70 | 2.13 | >2.8 |
| tors | V4 | 1.70 | 1.17 | 1.08 | 1.20 | 1.27 | 1.35 | 1.58 | 2.20 | 2.8 | |
| SWR | V1 | 2.20 | 1.62 | 1.43 | 1.58 | 1.76 | 1.72 | 1.60 | 1.37 | 1.60 | 2.5 |
| without | V2 | 2.50 | 1.80 | 1.65 | 1.80 | 1.65 | 2.0 | 1.80 | 1.61 | 1.53 | 1.50 |
| direc- | V3 | 2.57 | 1.90 | 1.79 | 1.98 | 1.50 | 2.0 | 1.96 | 1.71 | 1.60 | 1.78 |
| tors | V4 | 2.38 | 1.80 | 1.64 | 1.81 | 1.96 | 1.93 | 1.72 | 1.56 | 1.86 | >2.8 |

As already mentioned, measurements of the coupling between the two antennas were also made, by moving them a greater or lesser distance apart, i.e., by taking several values for the distance P between the centers of the antennas. The results of measurments made for the three values of 65, 60 and 55 mm for P are indicated in Tables IV, V and VI below. The tests were made with and without director elements for P=65 and 55 mm and exclusively with director elements for P=60 mm. In each case, an indication has been given of the coupling between terminals V2 and V3 (or V2V3), between V1 and V4 (or V1V4) and between V1 and V3 (or V1V3).

TABLE IV

| | | P = 65 mm, or $P/\lambda_m$ = 0.8 | | | |
|---|---|---|---|---|---|
| | f(GHz) | 3.6 | 3.7 | 3.8 | 3.9 |
| Without | V2V3 | −20 | −27.5 | −26 | −22 |
| director | V1V4 | −23 | −23 | −24 | −29 |
| | V1V3 | <−40 | −31 | <−40 | <−40 |
| With | V2V3 | −19 | −22.5 | −25 | −20 |
| directors | V1V4 | −19 | −23 | −25 | −25 |
| | V1V3 | −37.5 | −30 | −36 | <−40 |

TABLE V

| | | P = 60 mm, or $P/\lambda_m$ = 0.74 | | | |
|---|---|---|---|---|---|
| | f(GHz) | 3.6 | 3.7 | 3.8 | 3.9 |
| With | V2V3 | −25 | −20 | −22 | −21 |
| directors | V1V4 | −20 | −30 | −30 | −24 |
| | V1V3 | −35 | −28 | −38 | −36 |

TABLE VI

| | | P = 55 mm, or $P/\lambda_m$ = 0.68 | | | |
|---|---|---|---|---|---|
| | f(GHz) | 3.6 | 3.7 | 3.8 | 3.9 |
| Without | V2V3 | −23 | −18 | −24 | −20 |
| director | V1V4 | −20 | −17.5 | −18 | −22 |
| | V1V3 | −22 | −25 | −34 | −35 |
| With | V2V3 | −25 | −19 | −31 | −21 |
| directors | V1V4 | −20 | −19 | −18 | −22 |
| | V1V3 | −25 | −25 | −31 | −30 |

Tables IV, V and VI indicate that the presence of the director elements contributes to a slight increase in the couplings for the largest distance P, $P/\lambda_m$=0.8 (Table IV), but that for the smallest distance P, $P/\lambda_m$=0.68 (Table VI), the coupling without a director is a bit stronger than for $P/\lambda_m$=0.8, and the changes due to the director elements are insignicant.

In conclusion, the director elements in FIGS. 9 and 10 increase the passband of the antenna or improve the adaptation of its input impedance. The presence of the director elements does not increase the coupling between antennas, and this coupling remains sufficiently low, so that the antennas according to the invention, fitted with director elements, can be used to construct arrays.

We claim:

1. A plate antenna module with double crossed polarizations, the radiating part of which comprises two similar thick element folded radiating doublets (1,3; 2,4) characterized by the fact that two doublets are located in a common plane in orthogonal relation to each other, and slots are defined of comparatively narrow width so as to operatively effect a common doublet gap between the driven elements of the doublets intersecting one another at the center (C) of the unit antenna.

2. A plate antenna module according to claim 1, characterized by the fact that the two unit doublets (1,3; 2,4) are respectively associated with central conductors (27, 30) for three-plate lines which are orthogonal with their extensions which cross one another beneath the center (C) of the antenna, with each three-plate line comprising the plates (1,3; 2,4) of a doublet and a reflector (31), and between the plates and the reflector, the central conductor (27 or 30), with the reflector (31) is common to the two doublets.

3. A plate antenna module according to claim 1 or 2, characterized by the fact that the two doublets are comprised of four plates (1 through 4) separated by a nonconductive cross (5 through 8) whose center coincides with the center (C) of the plate antenna module, with each end of an arm (5, 6, 7 or 8) of the cross ending in a first nonconductive area (11, 12, 13 or 14) defined on the outside by a conductive strip (16, 17, 18, or 19) connected to the rear parts of the two plates (1, 2, 3, or 4) adjacent to the said arm, a second finite nonconductive area (20, 21, 22 or 23) being provided beyond the conductive strip (16, 17, 18 or 19), with the first areas, the strips and the second areas being symmetrical with respect to the center (C) of the unit antenna and to the axes of symmetry (X-X', Y-Y') of the doublets.

4. A plate antenna module according to claim 3, characterized by the fact that it is constructed in the form of a first printed circuit (25) with a first metallized surface (24) from which the cross, the first areas and the second areas have been removed, and a second metallized surface (26) on which all that remains is the first central conductor (27) and a second printed circuit (28) with a first surface (29) on which all that remains is the second central conductor (30) and a second completely metallized surface (31) serving as a reflector, with the two printed circuits (24, 28), being superposed with an insulating layer (32) between them.

5. A plate antenna module according to claim 4 characterized by the fact that director elements (37 through 40) are placed in front of the plates (1 through 4) and separated from them by an insulating layer.

6. A plate antenna according to claim 5 characterized by the fact that each of the direction elements is formed from a long rectangular strip of material, with the four strips being oriented along the arms of a cross whose center coincides with the center of the antenna and whose orientation coincides with the axes of symmetry (X-X', Y-Y') of the plates of the doublets, respectively, with the origins of the conductive strips being located relatively near the center of the cross.

7. A plate antenna module according to claim 5 characterized by the fact that the ends of the director elements (37 through 40) which are the furthest from the center are located between the center and the outermost element defining said radiating part.

8. An array of plate antennas, characterized by the fact that it comprises plate antenna modules according to claim 7 and that the first central conductors (27) are all associated with the first doublets, and the second central conductors (30) are all associated with the second doublets.

9. A plate antenna module with double crossed polarizations, the radiating part of which comprises two thick element folded radiating doublets (1,3; 2,4), characterized by the fact that two doublets are located in a single plane and are orthogonal, with slots between the driven elements of the doublets crossing one another at the center (C) of the unit antenna;

said two unit doublets (1,3; 2,4) are respectively associated with central conductors (27, 30) for three-plate lines which are orthogonal with their extensions which cross one another beneath the center (C) of the antenna, with each three-plate line comprising the plates (1,3; 2,4) of a doublet and a reflector (31), and between the plates and the reflector, the central conductor (27 or 30), with the reflector (31) is common to the two doublets;

said two doublets being comprised of four plates (1 through 4) separated by nonconductive comparatively narrow cross slots (5 through 8) whose center coincides with the center (C) of the plate antenna module so as to render said slots operatively effective as a common doublet gap between said doublets, with each end of an arm (5, 6, 7 or 8) of the cross slots ending in a first nonconductive areas (11, 12, 13 or 14) defined relatively outward by a conductives strip (16, 17, 18, or 19) connected to the rear parts of the two plates (1, 2, 3, or 4) adjacent to the said arm, a second finite nonconductive area (20, 21, 22 or 23) being provided beyond the conductive strip (16, 17, 18 or 19), with the first areas, the strips and the second areas being symmetrical with respect to the center (C) of the unit antenna and to the axes of symmetry (X-X', Y-Y') of the doublets; and director elements (37 through 40) are positioned in front of the plates (1 through 4) and separated from them by an insulating layer.

10. A plate antenna module according to claim 9, characterized by the fact that it is constructed in the form of a first printed circuit (25) with a first metallized surface (24) from which the cross, the first areas and the second areas have been removed, and a second metallized surface (26) on which all that remains is the first central conductor (27) and a second printed circuit (28) with a first surface (29) on which all that remains is the second central conductor (30) and a second completely metallized surface (31) serving as a reflector, with the two printed circuits (24, 28), being superposed with an insulating layer between (32) them.

11. A plate antenna according to claim 10 characterized by the fact that each of the director elements is formed fom a long rectangular strip of material, with the four strips being oriented along the arms of a cross whose center coincides with the center of the antenna and whose orientation coincides with the axes of symmetry (X-X', Y-Y') of the plates of the doublets, respectively, with the origins of the conductive strips being located relatively near the center of the cross.

12. A plate antenna module according to claim 11 characterized by the fact that the ends of the director elements (37 through 40) which are the farthest from the center are located within the radiating structure of the antenna.

13. An array of plate antennas, characterized by the fact that it comprises plate antenna modules according to claims 9, 10, 11 or 12 and that the first central conductors (27) are all associated with the first doublets, and the second central conductors (30) are all associated with the second doublets.

* * * * *

UNITED STATES PATENT AND TRADEMARK OFFICE

CERTIFICATE OF CORRECTION

PATENT NO. : 4,922,263

DATED : May 1, 1990

INVENTOR(S) : Gerard Dubost, Rennes; Roger Frin, Liffre, both of France

It is certified that error appears in the above-identified patent and that said Letters Patent is hereby corrected as shown below:

Column 1, line 20 "applicatants " should read -- applicants -- ;

Column 1, line 45 "three-late" should read -- three-plate --;

Column 1, line 68 "in" should read -- is --;

Column 2, line 28 "original" should read -- other --;

Column 4, line 4 "plate 3" should read -- plate 2 --;

Column 7, line 60 "measurments" should read -- measurements --;

Column 8, line 35 "insignicant" should read -- insignificant --;

Column 9, line 41 "direction" should read -- director --;

Column 10, line 19 "areas" should read -- area --;

Column 10, line 21 "conductives" should read -- conductive --.

Signed and Sealed this

Twenty-sixth Day of March, 1991

*Attest:*

HARRY F. MANBECK, JR.

*Attesting Officer*

*Commissioner of Patents and Trademarks*